United States Patent [19]

Gryctko

[11] 3,970,975

[45] July 20, 1976

[54] GROUND FAULT CIRCUIT BREAKER WITH GROUND FAULT TRIP INDICATOR

[75] Inventor: Carl E. Gryctko, Haddon Heights, N.J.

[73] Assignee: I-T-E Imperial Corporation, Spring House, Pa.

[22] Filed: May 5, 1975

[21] Appl. No.: 574,596

[52] U.S. Cl. ..... 335/18; 335/17

[51] Int. Cl.[2] ..... H01H 83/02

[58] Field of Search ..... 335/18, 17; 317/18 D

[56] References Cited

UNITED STATES PATENTS

| | | | |
|---|---|---|---|
| 3,440,580 | 4/1969 | Molenaar | 317/18 D |
| 3,855,502 | 12/1974 | Parde et al. | 335/18 |
| 3,864,649 | 2/1975 | Doyle | 335/18 |

*Primary Examiner*—Harold Broome

*Attorney, Agent, or Firm*—Ostrolenk, Faber, Gerb & Soffen

[57] ABSTRACT

A circuit breaker module and a detector module are mounted side by side to form a ground fault interrupter. The detector module includes an electromagnet for mechanical engagement with operation of the automatic trip device of the circuit breaker to open the latter upon the occurrence of predetermined ground fault conditions. An indicator member is pivotally mounted between the detector and circuit breaker modules. When the electromagnet is energized, it moves the indicator member from a retracted to an indicating position. In the latter position a portion of the indicator member is readily visible to indicate that tripping has resulted from a ground fault rather than from an overload.

10 Claims, 6 Drawing Figures

FIG. 1.
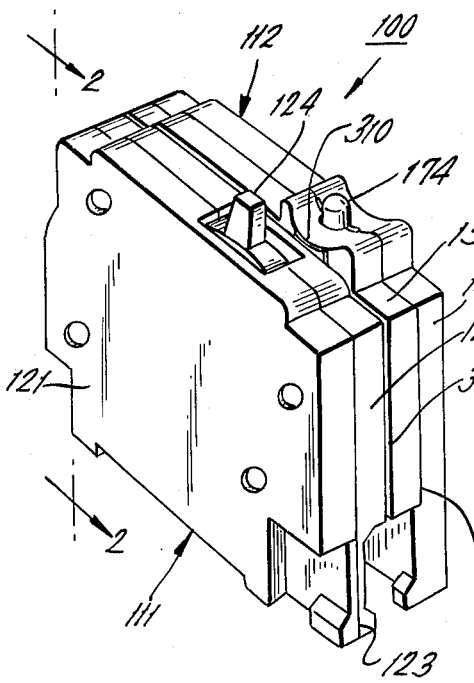
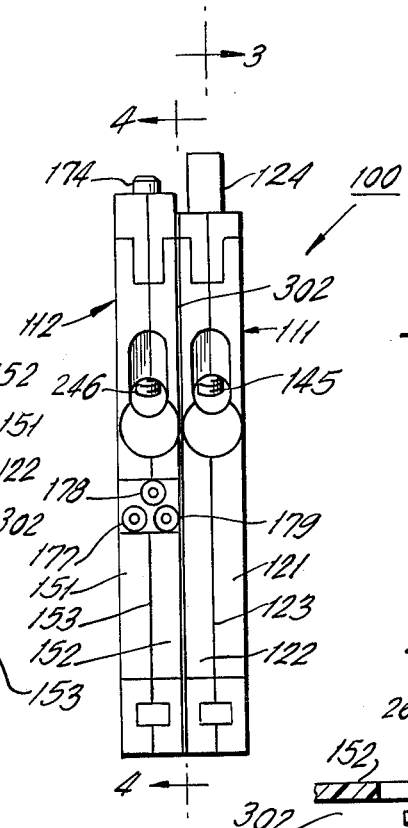
FIG. 2.
FIG. 6.
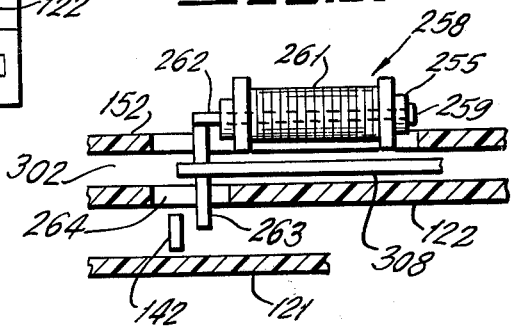
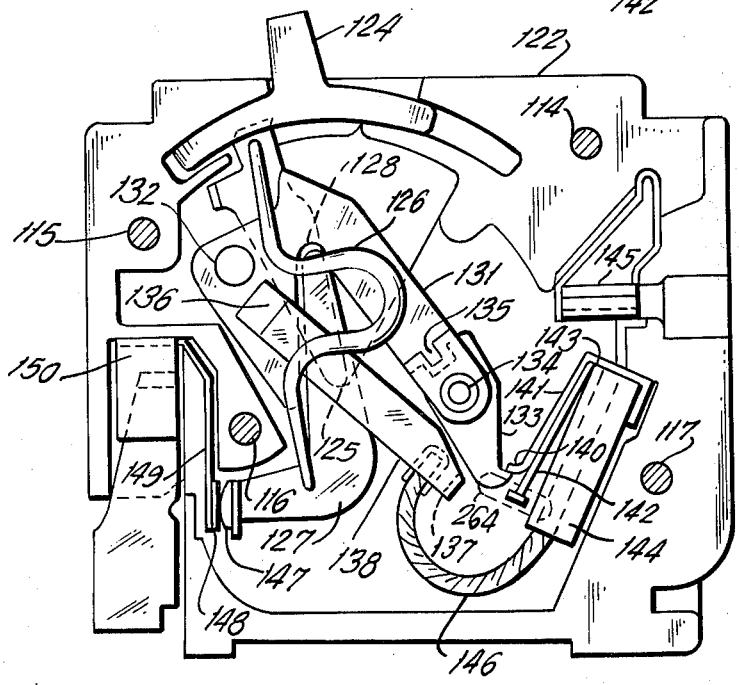
FIG. 3.

GROUND FAULT CIRCUIT BREAKER WITH GROUND FAULT TRIP INDICATOR

This invention relates to ground fault protective equipment in general and more particularly relates to equipment of this type having means to indicate whether automatic tripping has resulted from an overload current condition or a ground fault condition.

Recently there has been a significant increase in the utilization of ground fault protective equipment coordinated with automatic circuit breakers in a manner such that the circuit breaker is operative to open the circuit when a ground fault is detected therein. However, tripping of the circuit breaker does not indicate whether it has been caused by an overload or by a ground fault, so that corrective measures must be delayed until the nature of the fault condition is determined.

In accordance with the instant invention, means are provided to indicate whether automatic tripping of the circuit breaker has resulted from a ground fault or an overload current condition. This is accomplished by providing an indicator that is actuated only when automatic tripping is caused by a ground fault condition. Thus, when both the circuit breaker manual operating handle and the indicator member are in their trip indicating positions, ground fault tripping is indicated. However, with the circuit breaker handle in its trip position and the indicator member in its normal position, overload current tripping is indicated.

The indicator is an L-shaped member constructed of sheet material and is disposed in the very narrow space between a circuit breaker module and a detector module. The latter includes a balanced transformer for detecting the presence of a ground fault balance, amplifier means for amplifying ground fault signals, and an electromagnet operatively connected to the amplifier to be energized when the ground fault exceeds a predetermined level. The movable armature of the electromagnet actates the automatic trip means of the circuit breaker when the electromagnet is actuated, and the armature is also connected to the indicator for operation thereof to a ground fault trip indicating position when the electromagnet is energized. When tripping of the circuit breaker results from overload current conditions, the electromagnet of the detector module is not energized so that the indicator remains in a normal position to signify that tripping has not resulted from the occurrence of a ground fault.

Accordingly, a primary object of the instant invention is to provide a ground fault trip indicator for ground fault protective equipment having automatic trip means responsive to overload currents.

Another object is to provide ground fault protective equipment including an automatic circuit breaker module, a ground fault detector module, and a member disposed between these modules to present a visual indication of ground fault tripping.

Still another object is to provide ground fault protective equipment of this type in which the automatic trip means of the circuit breaker is actuated for both overload current and ground fault tripping, yet the ground fault indicating member remains in its normal position upon the occurrence of overload current tripping.

These objects as well as other objects of this invention shall become readily apparent after reading the following description of the accompanying drawings in which:

FIG. 1 is a perspective of a ground fault protector constructed in accordance with teachings of the instant invention.

FIG. 2 is an elevation looking in the direction of arrows 2—2 of FIG. 1 at the load end of the ground fault protector.

FIG. 3 is a cross-section of the circuit breaker module looking in the direction of arrows 3—3 of FIG. 2.

In FIG. 5 the ground fault trip indicator is shown mounted to the detector module.

FIG. 6 is a fragmentary elevation showing the relationship between the ground fault detector module trip extension and the overload responsive trip element of the circuit breaker module.

Figure 4:
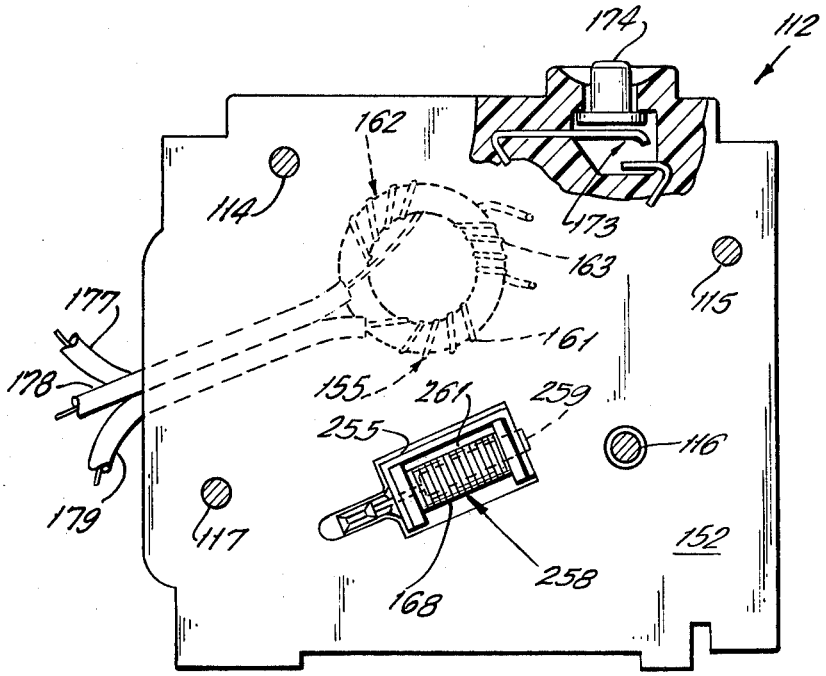
FIGS. 4 and 5 are side elevations of the detector module looking in the direction of arrows 4—4 of FIG. 2.

Now referring to the figures. Ground fault interrupting unit 100 includes circuit breaker module 111 and detector module 112 approximately of equal width mounted in side-by-side relationship by at least two of the four rivets 114-117. As noted in the V. G. Pardue et al. U.S. Pat. No. 3,855,502 issued Dec. 17, 1974, for a Ground Fault Interrupter Device, circuit breaker module 111 is a standard half-inch wide single pole circuit breaker of the type described in detail in U.S. Pat. No. 3,152,232 issued Oct. 6, 1964, to J. H. Leonard for Circuit Breaker Having Bimetal Rigidly Secured To Cradle.

Briefly, circuit breaker module 111 of FIG. 1 includes an insulating housing constructed of molded elements 121, 122, joined along line 123 to define compartment means wherein the electrical and mechanical operating elements of module 111 are disposed. Operating handle 124, pivoted at housing formation 125, has a manually engageable portion projecting out of the top of housing 121, 122. Formed wire spring 126 connects handle 124 to movable contact arm 127 and biases at the upper end 128 of contact arm 127 into abutment with the apex portion of an inverted V-shaped notch formed by cradle 131. The latter is pivoted at housing formation 132 and carries insulating latch tip member 133 on pivot 134. Pivotal movement of member 133 is limited by cradle formation 135. End 136 of bimetal strip 138 is fixedly secured to cradle 131. Formation 137 at the free end of bimetal 138 extends at right angles to the plane of movement for cradle 131 and normally maintains member 133 in position for engagement by latch 140. The latter is formed at one end of spring member 141 which carries magnetic armature 142 and biases the latter in a clockwise direction about pivot point 143, so as to normally form a V-shaped notch with the pole faces of U-shaped magnetic yoke 144.

The current path through circuit breaker module 111 extends from load terminal 145 through flexible braid 146 to the lower end of bimetal 138, through bimetal 138 to cradle 131 and its abutting connection with movable contact arm 127, through arm 127 and movable contact 147 carried by arm 127, and stationary contact 148 mounted to strap-like extension 149, and through extension 149 to line terminal 150.

Braid 146 passes between the arms of yoke 144 and forms the energizing turn for magnet 142 so that when overload fault current flows through ciruit breaker module 111, armature 142 is attracted to yoke 144 thereby moving latch 140 to the right with respect to FIG. 3 to free latch tip member 133 and permit operating spring 126 to move cradle 131 in a counterclockwise direction with respect to FIG. 3 and separate movable contact 147 from stationary contact 148.

Detector module 112 includes a compartment formed by the cooperation of molded insulating housing members 151, 152 joined side by side along line 153. Disposed within housing 151, 152 is a ground fault protecting means including balanced transformer 155, a circuit board (not shown) and electromagnetic operator 258. Balanced transformer 155 includes identical primary windings 161, 162 of relatively few turns and secondary winding 163 having many more turns than either of the primary windings 161 or 162. All three windings 161-163 are wound on a torroidal core, with one lead of winding 161 connected to load end terminal 246 and the other three primary winding leads (lead 177 from the other end of winding 161 and leads 178, 179 from winding 162) extending from housing 151, 152 at the load end thereof. The ends of secondary winding 163 are connected to the circuit board at its input terminals.

The printed circuit board of module 112 contains elements (not shown) for amplifying signals fed from transformer 155 to produce a control signal for energizing winding 261 of electromagnetic operator 258. Suitable circuitry for the circuit board is described in U. S. Pat. No. 3,555,369 issued Jan. 12, 1971, to A. R. Morris et al. for a Circuit Protective Device. Although not illustrated herein, lead 177 is connected to load terminal 145.

Detector module 112 also includes normally open test switch 173 having operating push-buttons 174 extending through the top of housing 151, 152. The closing of 173 is effective to create an unbalanced condition in transformer 155 of sufficient magnitude to cause actuation of tripping magnet 258.

Figure 5:
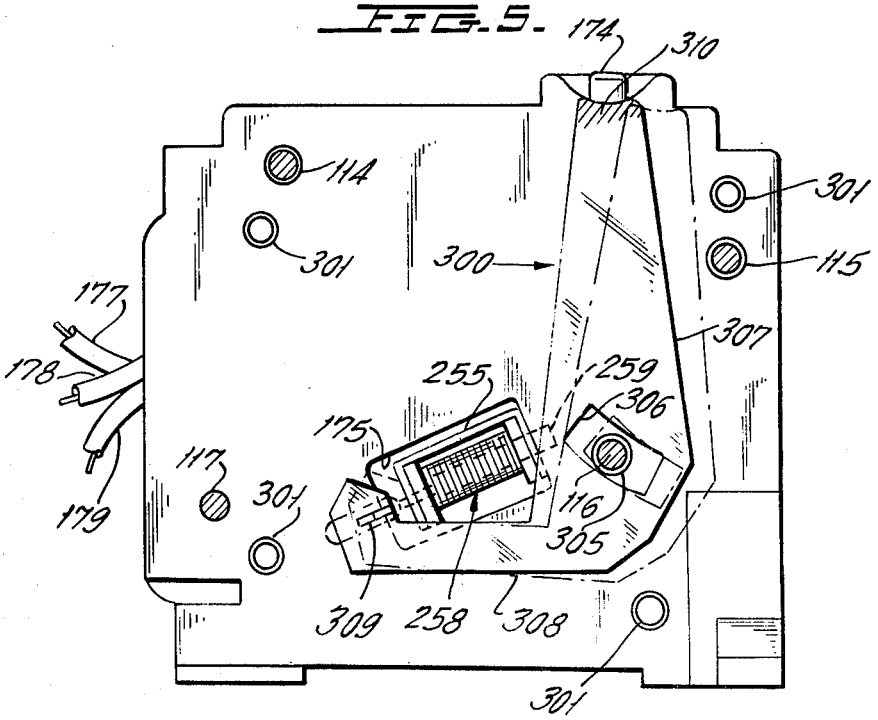

Energizing winding 261 of electromagnet 258 is positioned between the arms of U-shaped frame 255 and surrounds rod-like cylindrical armature 259. The latter is axially movable from right to left with respect to FIGS. 4-6 upon energization of winding 261. The left end of armature 259, as viewed in FIG. 6, is provided with axial extension 262 having radial offset 263 at the free end thereof. Offset 263 extends through elongated slot 264 (shown phantomed in FIG. 3) in circuit breaker housing part 122 and lies adjacent to armature 142 in circuit breaker module 111. Slot 264 is slightly wider than the diameter of offset 263 so that slot 264 as well as a portion of aperture 175 in detector module housing part 152 guide movement of offset 263 when winding 261 is energized. Upon the occurrence of a ground fault of sufficient magnitude being detected by module 112, electromagnet 258 is actuated to move its armature 259 axially to the left with respect to FIGS. 4-6, with radial projection 263 engaging and moving armature 142 to release circuit breaker latch 140, thereby bringing about separation of circuit breaker contacts 147, 148. However, when armature 142 is moved as a result of overload current detected by the automatic trip means of circuit breaker module 111 extension 263 remains stationary.

The surface of housing part 152 confronting circuit breaker module 111 is provided with four bosses 301 which bear against housing part 122 to form narrow space 302 wherein L-shaped indicating member 300 is disposed. Space 302 is slightly wider than the thickness of member 300 so as not to restrict movement of the latter. Typically, space 302 is approximately 0.047 inch wide and member 300 is typically 0.032 inch thick.

Member 300 is pivotally mounted on boss 305 that projects from housing part 152 into arcuate slot 306 of member 300 located in the vicinity where its leg 307 is joined to its foot 308. The free end of foot 308 is provided with clearance aperture 309 through which axial projection 263 of armature 259 extends. Thus, when electromagnet 258 is energized upon the detection of a ground fault of sufficient magnitude, armature 259 moves to its left position with respect to FIG. 6 to trip circuit breaker 111 and at the same time indicator member 300 is pivoted counterclockwise about embossment 305 from the phantom position shown in FIG. 5 to the solid line position.

In the latter position the free or indicating end 310 of leg 307 moves to an indicating position where it is visible in the region of test button 174. It should now be apparent that if circuit breaker module 111 trips because of overload currents, trip indicator 300 will remain in the retracted position shown in phantom in FIG. 5 where indicating end 310 is, for purposes of this invention, not visible.

Thus, with circuit breaker handle 124 in its mid or trip indicating position, if indicator portion 310 is not retracted then tripping has been caused by an overload current condition whereas if indicator portion 310 is visible then tripping has resulted from a ground fault condition.

Although in the foregoing there have been described preferred embodiments of this novel invention, many variations and modifications will now become apparent to those skilled in the art, and it is preferred therefore that the instant invention be limited not by the disclosure contained herein but only by the appending claims.

The embodiments of the invention in which an exclusive privilege or property is claimed are defined as follows:

1. Electrical protective equipment comprising a circuit breaker including a set of cooperating contacts, an operating means connected to said set of contacts and including an operating handle and a latchable member, latch means for maintaining said latchable member in latched position wherin said operating means through manual operation of said handle is effective to open and close said set of contacts, overload sensing means for actuating said operating means to open said contacts by automatically operating said latch means to release said latchable member upon the occurrence of predetermined overload conditions; fault responsive means including a fault detecting means and an electromagnet energized by said fault detecting means upon the occurrence of predetermined fault conditions; said electromagnet including a relatively stationary magnetic yoke and an armature movable relative to said yoke; trip means operated by said armature means upon energization of said electromagnet to move said latch means and thereby release said latchable member whereby said operating means opens said set of contacts; indicator means operated by said armature means upon energization of said electromagnet to move said indicator means from a retracted to an indicating position wherein an indicating portion thereof is readily viewable to indicate that said predetermined fault condition has occurred.

2. Electrical protective equipment as set forth in claim 1 in which the indicator means remains in said retracted position upon opening of said contacts as a result of actuation of said overload sensing means.

3. Electrical protective equipment as set forth in claim 2 in which said armature is guided for straight line motion and said indicator means is mounted for pivotal motion.

4. Electrical protective equipment as set forth in claim 1 in which the circuit breaker constitutes a first module including a first housing and the fault responsive means constitutes a second module including a second housing secured in side by side relationship with said first housing; said indicator means being operatively positioned between said housings.

5. Electrical protective equipment as set forth in claim 4 in which the trip means extends between the housings and operatively engages the indicator means.

6. Electrical protective equipment as set forth in claim 5 in which the handle is positioned to extend forward of the first housing at the front thereof; said portion of said indicating means being positioned generally in the region of said handle when said indicator means is in its said indicating position.

7. Electrical protective equipment as set forth in claim 6 in which the indicator means comprises a first leg and a second leg extending from said first leg at a joining region and transverse with respect thereto; said indicating portion being an end of said first leg remote from said joining region and said trip means engaging said second leg at an end thereof remote from said joining region.

8. Electrical protective equipment as set forth in claim 7 in which there is a pivot means operatively mounting said indicator means; said pivot means being disposed at said joining region.

9. Electrical protective equipment as set forth in claim 8 in which the pivot means includes a fixed portion extending from one of said housings through a slot in said indicator means; said trip means being guided for movement away from said fixed portion upon energization of said electromagnet.

10. Electrical protective equipment as set forth in claim 9 in which the indicator means remains in said retracted position upon opening of said contacts as a result of actuation of said overload sensing means.

* * * * *